US009283458B2

(12) United States Patent
Achkar

(10) Patent No.: US 9,283,458 B2
(45) Date of Patent: Mar. 15, 2016

(54) SOCCER TRAINING DEVICE

(71) Applicant: Michael Allan Achkar, San Jose, CA (US)

(72) Inventor: Michael Allan Achkar, San Jose, CA (US)

( * ) Notice: Subject to any disclaimer, the term of this patent is extended or adjusted under 35 U.S.C. 154(b) by 0 days.

(21) Appl. No.: 14/302,414

(22) Filed: Jun. 11, 2014

(65) Prior Publication Data

US 2015/0360107 A1 Dec. 17, 2015

(51) Int. Cl.
*A63B 69/00* (2006.01)
*A63B 71/06* (2006.01)

(52) U.S. Cl.
CPC ..... *A63B 69/002* (2013.01); *A63B 69/0079* (2013.01); *A63B 71/0619* (2013.01); *A63B 71/0686* (2013.01); *A63B 2220/17* (2013.01); *A63B 2220/833* (2013.01)

(58) Field of Classification Search
CPC ..... A63B 69/0091; A63B 69/0079; A63B 69/002; A63B 2071/026; A63B 2243/0025
USPC ..... 473/423, 424, 427, 429, 430, 446
See application file for complete search history.

(56) References Cited

U.S. PATENT DOCUMENTS

| | | | | |
|---|---|---|---|---|
| 2,818,255 | A * | 12/1957 | Ponza | 473/429 |
| 3,498,613 | A * | 3/1970 | Dreyer | 473/575 |
| 4,561,661 | A * | 12/1985 | Walker et al. | 473/423 |
| 4,616,834 | A * | 10/1986 | Davis | 473/429 |
| 5,553,848 | A * | 9/1996 | Amron | 473/416 |
| 5,755,630 | A * | 5/1998 | Malwitz | 473/429 |
| 5,788,589 | A * | 8/1998 | Koo et al. | 473/429 |
| 5,957,789 | A * | 9/1999 | Ainscough et al. | 473/423 |
| 6,475,108 | B1 * | 11/2002 | Sarenana et al. | 473/420 |
| 7,811,183 | B1 * | 10/2010 | Ohle | 473/429 |
| 8,262,516 | B2 | 9/2012 | Fuentes | |
| 8,932,155 | B2 * | 1/2015 | Moore | 473/423 |
| 2005/0282664 | A1 | 12/2005 | Beatty | |
| 2006/0189417 | A1 | 8/2006 | Evans et al. | |
| 2010/0130312 | A1 * | 5/2010 | Fuentes | 473/429 |
| 2011/0287871 | A1 * | 11/2011 | Pan et al. | 473/429 |
| 2013/0337945 | A1 * | 12/2013 | Marks et al. | 473/423 |

* cited by examiner

*Primary Examiner* — Mark Graham
(74) *Attorney, Agent, or Firm* — Delphine James

(57) ABSTRACT

A soccer training device is disclosed to improve the accuracy of a sport participant in the kicking of a soccer ball. The invention develops a soccer player's ball control using all parts of the foot including: first touch, striking, dribbling, trapping, rolling, and passing. The invention is made up of 5 main parts: Tethered Soccer Ball, Adjustable Rope, X-Y Rotation device, Base Plate and a Digital Counter/Timer which keeps track of the rotations. The training device comprises a weighted ground level base plate that supports the X-Y rotation device. The horizontal and vertical rotating axis apparatus extends upward and outward attaching to a tethered soccer ball. The ball attachment is connected to the apparatus with a rope. When kicked, the device allows for the ball to move across the floor in an uniform 360° motion. The device minimizes friction at the axis points and absorbs inertia allowing the ball to roll on the floor minimizing bounce at maximum acceleration for repeated rotations and constant delivery without rope fraying, encumbrance to the kicker, and base plate movement.

14 Claims, 7 Drawing Sheets

SOCCER TRAINING DEVICE

FIELD OF INVENTION

This invention relates generally to sport training devices and more particularly to a soccer practice training device.

BACKGROUND OF THE INVENTION

Soccer is a sport that has vast global appeal which transcends national, cultural, religious, class and gender boundaries. Soccer's appeal is expected to grow with an ever-expanding audience throughout the world. The success of any team lies in the continual perfection of skill in its individual players. It is estimated that there are over 240 million registered soccer players worldwide, and the numbers are only expected to grow. With such numbers, there is a value in improved training techniques and equipment.

When an individual player desires to practice on his or her own, difficulty arises from maintaining a consistent kicking and retrieval of the soccer ball. A device that returns the soccer ball after a player kicks during individual practice is beneficial. Thus, a training device that approximates the normal play and facilitates the development of the soccer player is desired in the field.

SUMMARY OF THE INVENTION

The principle objective of the present invention is to provide a method and equipment that develops improved development of skills and athletic performance. This will be apparent to those skilled in this field from the following description of aspects of the invention.

It is an object of the present invention to provide an improved method and equipment to facilitate the development of handling a soccer ball specifically perfecting a soccer player's first touch, striking, dribbling, trapping, rolling and passing.

The training device consists of a housing encompassing a rotating assembly that is perpendicularly attached atop a weighted base platform. A swivel joint extends perpendicularly outward from top end of housing to allow for a tethered soccer ball attachment. The training device allows for the user to kick the tethered soccer ball repetitively at approximately 150 revolutions per minute (RPM) or kicks per minute (KPM). The ball will move across the floor in a 360° rotating motion. The motion of the ball allows for rotations so that is constantly delivered back to the user without bounce. Power kick is absorbed by the built-in inertia absorbing member which delivers a flat and smooth return minimizing weighted base movement.

DESCRIPTION OF THE DRAWINGS

The present invention together with the above and other advantages may best be understood from the following detailed description of the embodiments of the invention illustrated in the drawings wherein.

DETAILED DESCRIPTION OF THE PREFERRED EMBODIMENT

Figure 1:
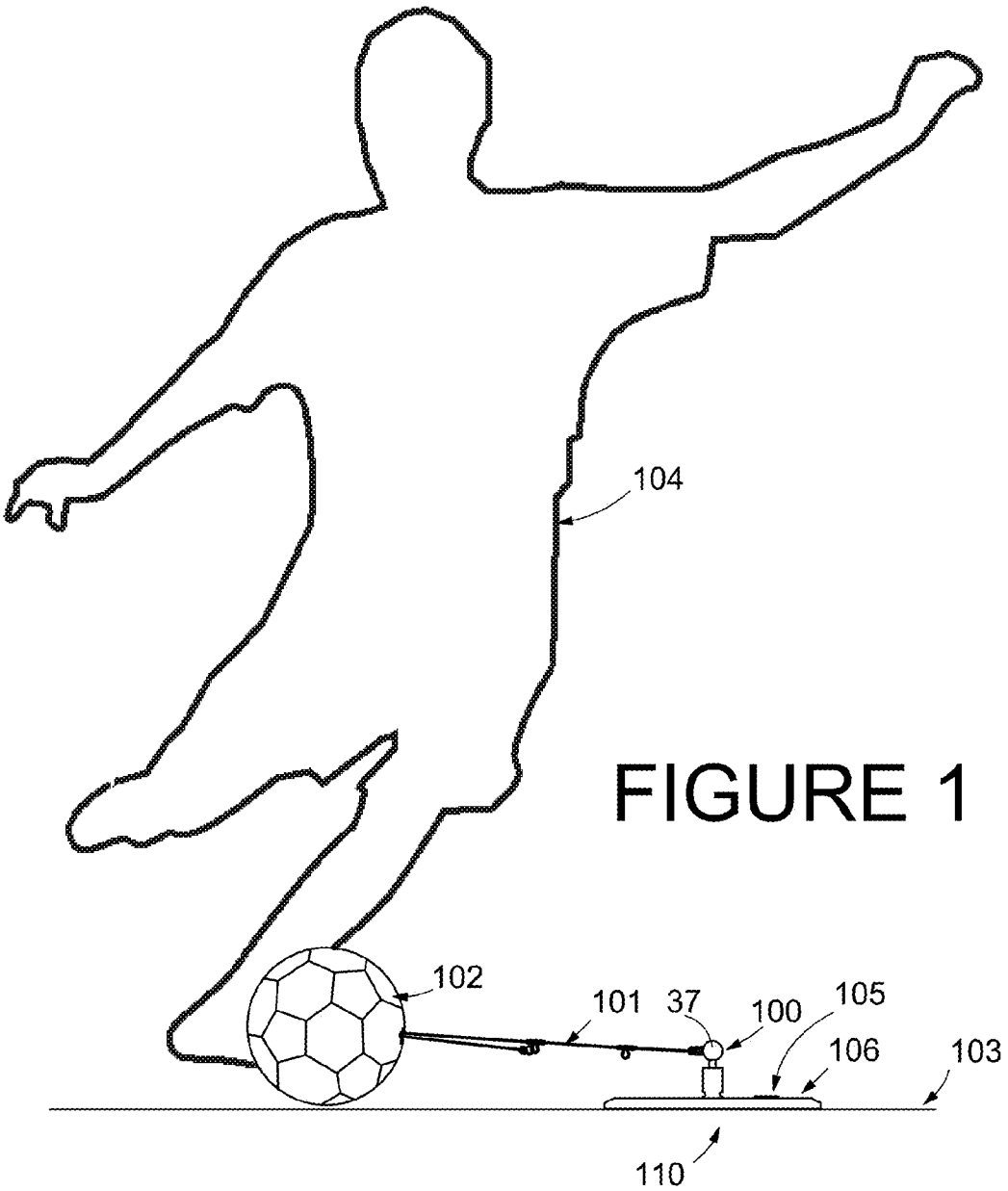
FIG. 1 is a perspective view of a embodiment of a weighted ball training device in accordance with the present invention.
Figure 2:
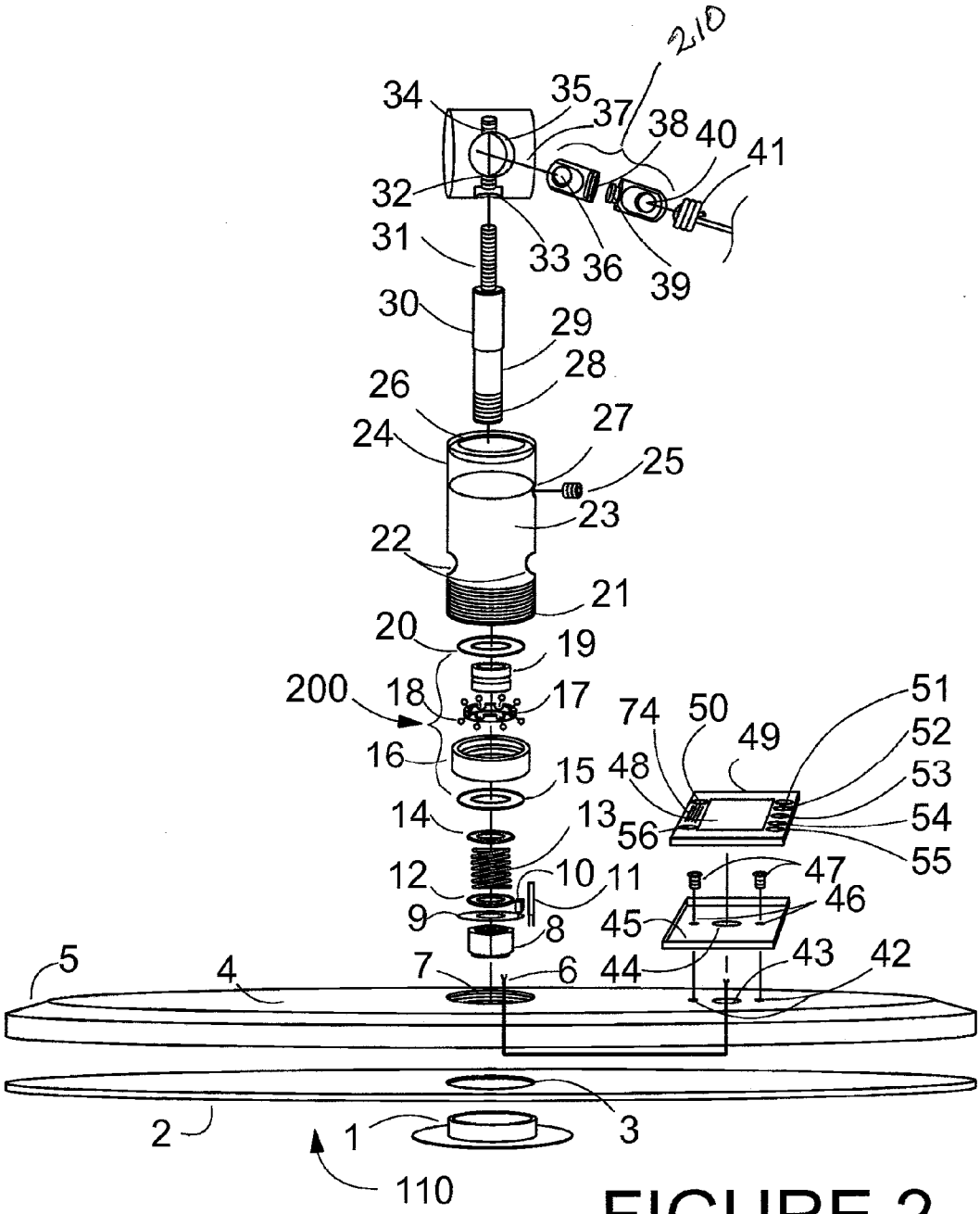
FIG. 2 depicts an exploded view of the rotation assembly atop the weighted base plate.

FIG. 1 illustrates one embodiment of a soccer training device (10) in accordance with the present invention. The invention comprises a tethered soccer ball (102), adjustable rope (101), X-Y rotation assembly (100), weighted base plate (106) and a digital counter/time (105). In use, as shown in FIG. 1, the soccer player (104) kicks a tethered soccer ball (102) at the midpoint target on the ball (102) creating a 360 degree rotation. Referring to FIGS. 2 and 1, X-Y rotating assembly (100) comprises a top connecting member operationally engaged with the top end of rotating shaft (30) which extends through housing (23) which encompass speed bearing assembly (200) and inertia absorbing member (13). Lower end (21) of housing (23) is securely engaged within weighted base (106) lying flat upon ground surface (103). The training area of the device in this embodiment is approximately 4'-0" in diameter so it can be played virtually anywhere including a family room or garage.

As shown in FIG. 1 X-Y rotating assembly (100) is perpendicularly and securely coupled within the top surface area of the weighted base (106). As depicted in FIG. 2, hollow cylindrical housing (23) has a lower end (21) that is securely engaged within the weighted base (106). Seated within the distal end of housing (23) is speed bearing assembly (200) disposed atop inertia absorbing member (13).

As shown in FIG. 2, weighted base (106) comprises a heavy plate (4) with opposing beveled edges (5) supported by skid free platform (2) for stabilizing the training device on a flat surface thereby preventing undesirable movement of device (10) during use. The Plate (4) is made of steel or another suitable heavy material and platform (2) is made of rubber or another suitable skid free material. Centrally located is an opening (7) that extends through plate (4) and platform (2) with bottom cap member (1) securing the opening (7) within the bottom side of platform (2). Weighted base (106) allows device (10) to be used on an indoor or an outdoor flat surface area (103) as shown in FIG. 1. Alternatively, training device (10) can be mounted directly into the ground.

Figure 3:
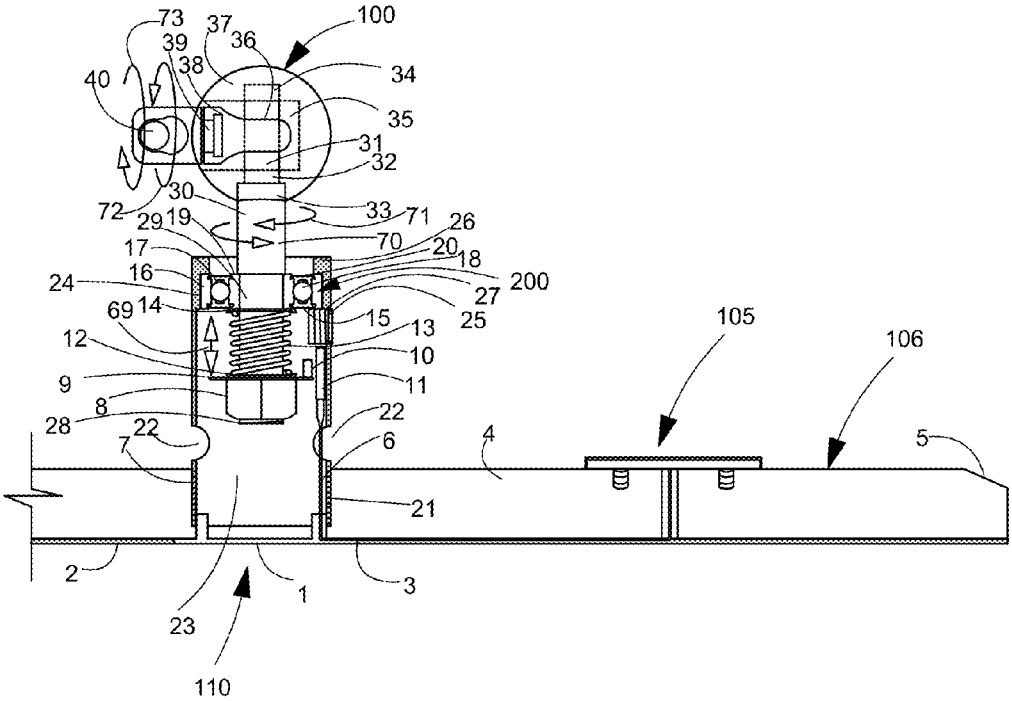
FIG. 3 depicts a cross-sectional perspective view of the rotation assembly secured to the weighted base plate.

Housing (23) is a hollow cylindrical tubular member (26) defined by a top portion (24) and a lower portion (21) which is secured into opening (7) of base (106) by tightening hole (22). Housing (23) is perpendicularly aligned above base (106) and encompasses the rotational assembly of device (10). As shown in FIG. 3 housing (23) which is threadedly engaged into the base plate (106) through opening (7). Housing (23) can be made of steel or another such material. The interior of the rotation post housing consists of three inside diameters made of 1" diameter round steel. The lower portion (21) of housing (23) is threaded into the base (106) with an approximate 23 mm inside diameter. This allows the outer ring (16) of speed bearing assembly (200) to pass thru the inner chamber of housing (23) and snuggly fit into the upper portion (24) of the housing (23) which is slightly larger than 22 mm outer ring (16). The top of the housing (23) has an even smaller inside diameter of 19 mm which stops the outer ring (16) of speed bearing (200) from passing through the upper end of tubular member (26).

In the illustrated embodiment in FIG. 2, speed bearing assembly (200) is made up of eight ball bearings (18) encapsulated between the outer ring (16) and the inner ring (19) by a retainer crown (17). The bearings (18) are then further protected by upper (20) and lower (15) shields. The speed bearing assembly (200) outer ring (16) is then secured to the housing by a set screw (25) through aperture (27) which in this embodiment is a threaded hole within the housing (23).

Rotating shaft (30) comprises a top end (31) and a lower end (28). Lower portion (29) of rotating shaft (30) has a smaller diameter than the upper segment of rotating shaft (30). Top end (31) of rotating shaft (30) securely engages within top connector member (37). Fastener (25) engages within aperture (27) securing rotating shaft (30) within housing (23). Lower end (28) extends downward and centrally through outer ring (16) and inertia absorbing member (13) and securely engages within fastener (8). Rotating shaft (30) is vertically aligned within housing (23) and has a lower end that is rotatably mounted to outer ring (16). Shaft member (30) is segmented with lower end of upper segment having a contacting base which seats upon friction absorbing member (16). The lower end of the upper segment rotates independently of the lower shaft portion.

Top connector member (37) comprises a central opening (35) which facilitates the interconnection of rotating shaft (30) to swivel connection (39). Top end (31) of shaft member (30) is rotatably connected to swivel connection (210) through opening (35) of connector member (37).

Swivel connection (210) is horizontally aligned with and rotatably mounted to the connector member (37) at one end. Swivel connection (210) comprises a female end (38) engaged with a male end (39). The adjustable rope (101) end is tied with a fisherman's knot (41) to the eye (40) of the male end swivel. The male end (30) is connected to the female end (38) creating a heavy duty swivel connection (210) through compression. The heavy duty swivel connection is rated at 1500 lb. The female eye (36) then passes through the hole (35) of connector member (37). The female eye (36) is than penetrated by the upper end (31) of speed bearing post (30) to create a secure connection thru the threaded holes (32 and 34). The middle portion of the rotating shaft (30) is then additionally secured by protruding into the connector member (37) hole (33). Swivel connection (210) opposing female and male portions horizontally rotate 360 degrees.

Inertia absorbing member (13) encircles lower end (29) of rotating shaft (30) and is operationally engaged beneath speed bearing assembly (200) preventing the movement of device (10) while in motion. In the illustrated embodiment, inertia absorbing member (13) is a spring vertically mounted beneath outer ring (16) encircling lower end (29) of rotating shaft (30). As depicted, the spring member of inertia absorbing member (13) is sandwiched between upper washer (14) and lower washer (15) acting as a shock absorber to reduce the soccer ball (102) inertia so the base plate (106) will stay stationary.

In operation, the soccer ball (102) may be kicked by the user (104) as the x-y rotating assembly (100) rotates 360 degrees above weighted base (106).

Figure 7:
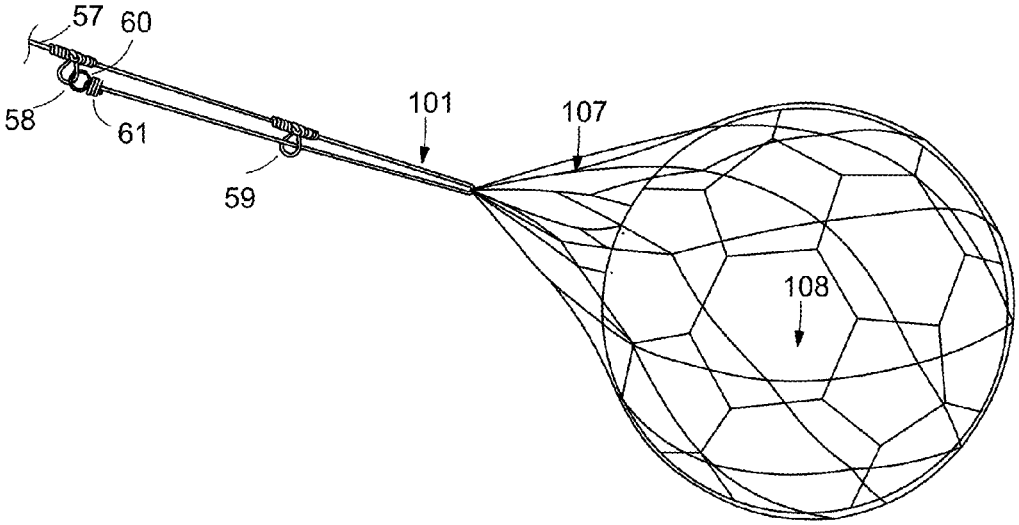
FIG. 7 depicts a perspective view of a netted ball with various tethered rope configurations.

The tethered soccer ball (102) size can vary from #3, #4, and #5 size ball depending on the age of the player. The soccer ball (102) is made up of an air bladder (66) with a rubber bladder stop (65) for the tethering pin (64) to be secured thereto. Wrapping the air bladder (66) is a skin (63) made up of stitched (67) vinyl, rubber, or leather hexagons. The soccer player's target, while striking the ball is the midpoint (68), allowing maximum rotation of the ball, kicks per minute (KPM). Alternatively, a soccer player can use a netted ball to tether the ball instead of the pin. (64). The tethered rope (101) can be adjusted accordingly to a player's skill level. FIG. 7 illustrates the netted ball connection (108).

Figure 5:
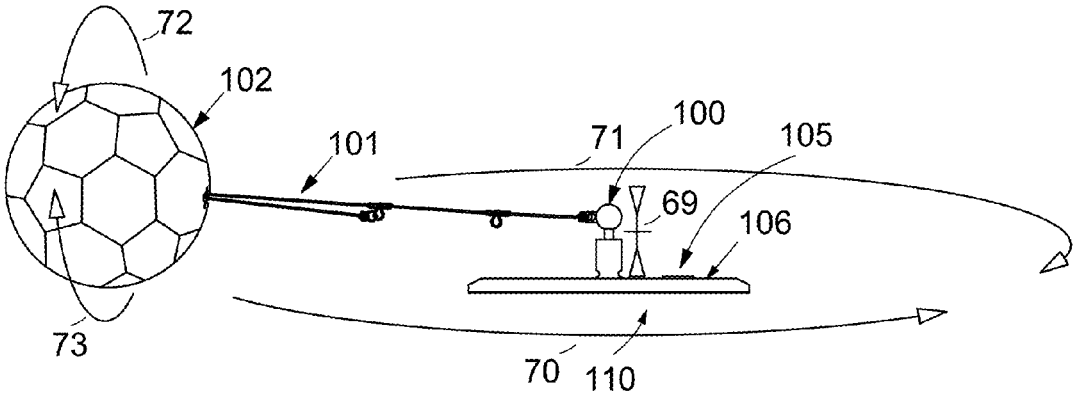
FIG. 5 depicts a perspective view of a second embodiment of a ground-mounted ball anchoring system in motion.

As shown in FIG. 5, the tethered ball (102) is attached to an adjustable length rope (101) that connects to rotational apparatus (100). The rotational apparatus (100) enables the ball to revolve in a 360 degree motion both vertically (72, 73) and horizontally (70, 71) in a clockwise and counter clockwise direction along the ground (103) supported by base (106).

Figure 4C:
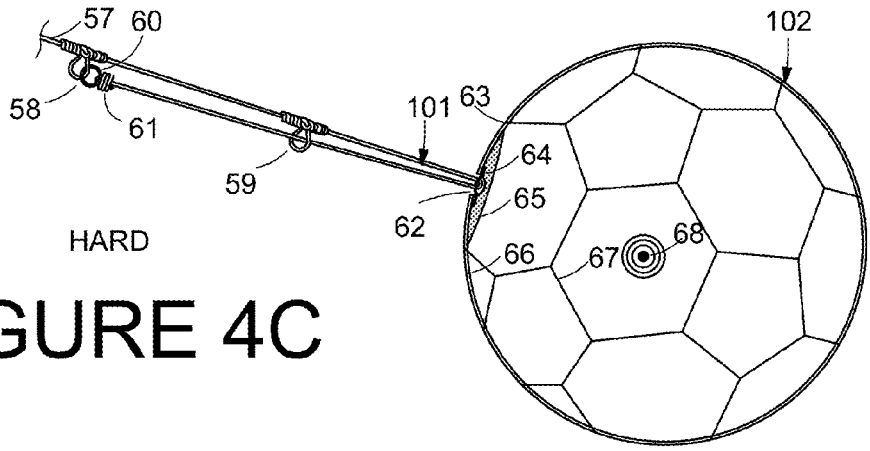
FIGS. 4A, 4B and 4C depict a perspective view of the various tethered rope configuration.
Figure 4B:
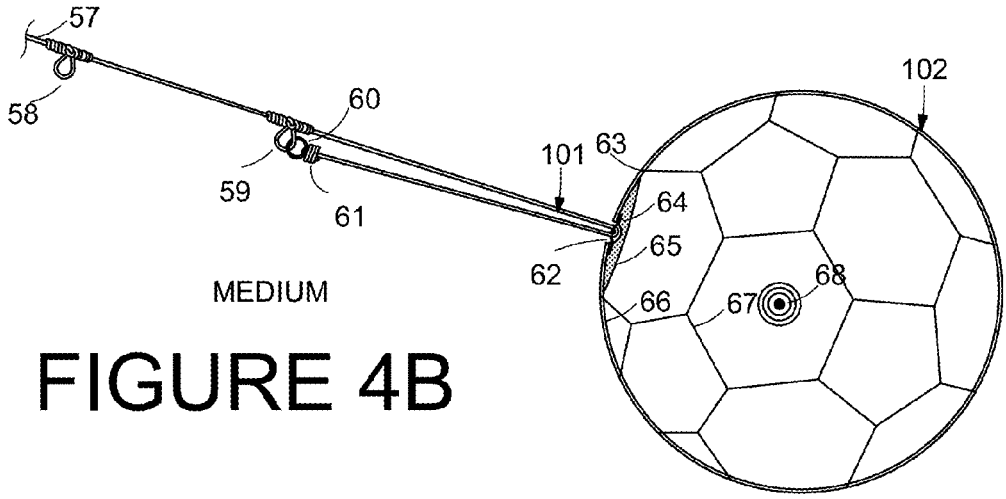
Figure 4A:
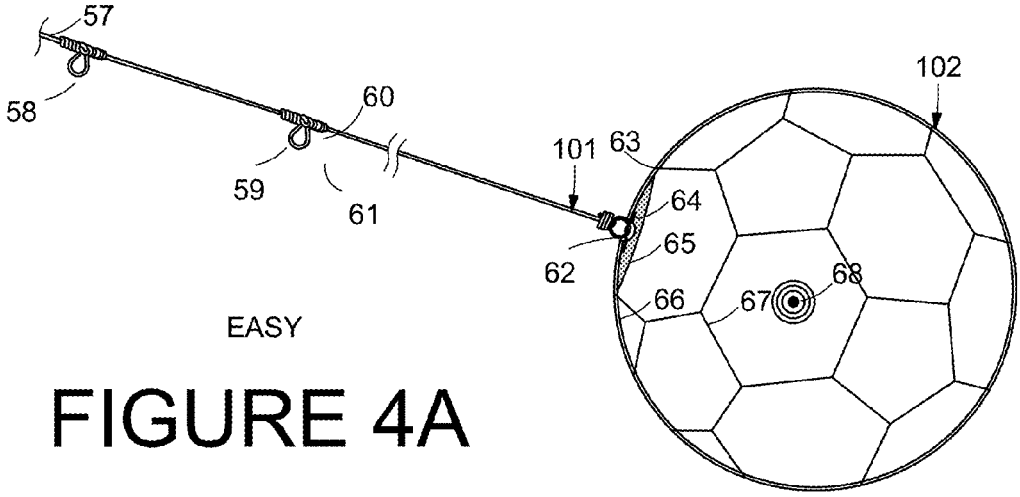

As shown in FIGS. 4A, 4B, and 4C tethered rope (101) has a mechanism for length adjustment to vary the rotational velocity of the return of soccer ball (102). The shorter the rope the quicker the ball returns to the player due to a reduced turning radius. The rotational apparatus' (100) connects to swivel joint opening (40) which connects the rope (57) by a fisherman's knot (41) and extends outward thru two loop knots (58, 59) and protrudes thru the tethering pin (62) of the soccer ball (102) and goes back to and connects a split ring (62) by a fisherman's knot (61) that is attached to loop knot one (58). FIG. 4A illustrates Hard Mode (12" radius). FIG. 4B illustrates two knots (58, 59) which is Medium Mode (18" radius). FIG. 4C illustrates the split ring (60) attached directly to the tethering pin (64) for novice mode (24" radius).

As shown in FIG. 2, between the fastener (8) and the bushing washer (12) is the counter mechanism washer (9) and magnet (10). Magnet (10) encircles lower end (28) of rotating shaft (29). As soccer ball (102) is being kicked, across the front of the Reed Relay switch (11) a closed circuit signal is created through the two wire chord (6) to the counter (105).

Counter (105) is formed wherein counter lower base (45) is screwed to counter housing (49) using a pair of parallel aligned screws (47) through a pair of complementary holes (46) to the pair of threaded holes (42) fixed to the weighted base (4) with the Reed Relay wire (6) protruding through the weighted base (4) holes (43) and the counter base holes (46) connecting to the digital board (48) disposed between counter lower base (45) sealed to counter housing (49).

Figure 6:
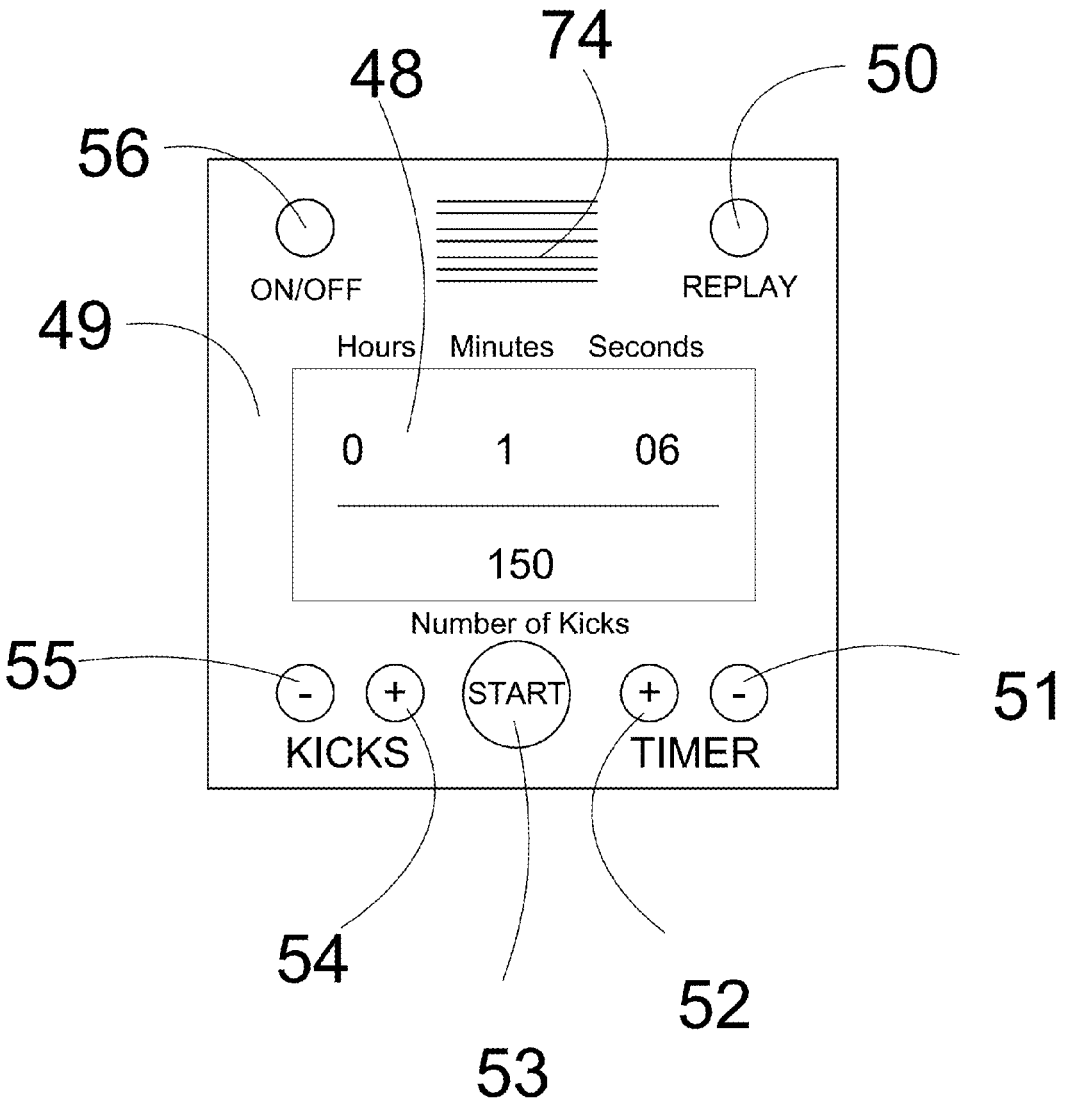
FIG. 6 depicts a perspective view of a digital counter/timer and digital display.

The counter (105) can have multiple functions for rating a player's performance. As illustrated in FIG. 6 is a sample display for digital board 48. In this illustrated embodiment, the first button on your top left corner is the ON/OFF (50) this lights up the digital display (48). Next, the player would set the kicks per minute (KPM) goal they wish to obtain. Kicks can be added using the "+" button (54) above "KICKS" and decreased by using the "–" button (55). Next, the timer buttons need to be set. To add time a player shall press the "+" button (52) above "TIMER" and the "–" button (51) to decrease kicks. Once the KPM is set, the "START" button (53) shall be pressed and the timer shall start counting down and the kicks will be tallied upon the first revolution made. The KPM counter has a speaker (74) that will announce the end of time and the result of achieving a Players KPM target. By announcing "GOAL" in several languages upon KPM target reached. In alternative embodiments, the counter (105) can also be configured to rate the strength of a kick by number of RPM's per kick as an option.

The Soccer Player (104) illustrated in FIG. 1 has the option of replaying the desired KPM by pressing the Replay button (50) or setting a new parameter. Once finished the KPM counter can be turned off pressing ON/OFF (56) or it will shut off after 10 minutes of non-play. The KPM counter can be linked thru Bluetooth to a phone app. This phone app will allow training applications and performance goals for individuals.

One of the advantages and the novelty of this invention is the low coefficient of friction allowing fast, smooth, and reliable ball rotation delivery in an x and y axis absorbing inertia through its shock absorbing post at over 150 revolutions per minute. No other device allows a player the number of foot touches per minute as the present invention.

What is claimed is:

1. A soccer training device comprising:

a soccer ball;

a tether mechanism having a first tether end and an opposing tether end, wherein the soccer ball is attached to the first tether end;

a swivel connector member having a 360 degree rotating element defined by a first end and an opposing end;

the opposing tether end horizontally attached to the opposing end of the swivel connector member;

a shaft member having a top shaft end and a lower shaft end and extending vertically downward through a hollow tubular housing;

the housing defined by a top portion and a lower portion;

an inertia member operationally engaged within the lower portion of the housing below a speed bearing assembly disposed within the upper portion of the housing thereby absorbing the movement of the device while in use;

the shaft member extending through the inertia member and the speed bearing assembly into the lower portion of the housing and being secured in place thereto;

the lower shaft end rotatably mounted within the speed bearing assembly;

a top connector interconnecting the first end of the swivel connector member to the top shaft end wherein a rotating x-axis formed by the rotating swivel connector member and a y-axis formed by the rotating shaft member; and a weighted base for supporting the device on a level plane and being securely coupled to the lower portion of the housing wherein as a user kicks the ball, the swivel connector member horizontally rotates 360 degrees along the x axis while the shaft member simultaneously vertically rotates 360 degrees along the y axis causing allowing the ball to rotate at least 150 rotations per minute.

2. The soccer training device of claim 1 wherein the tether mechanism is a rope.

3. The soccer training device of claim 1 wherein the tether mechanism is attached to an adjustable element wherein the tether mechanism length can be increased or decreased thereby varying the difficulty of the user rotations per minute.

4. The soccer training device of claim 1 wherein the tether mechanism includes a net.

5. The soccer training device wherein the tether mechanism extends 4 inches in diameter.

6. The soccer training device of claim 1 wherein the weighted base further comprises a plate made of a heavy material with a flat bottom surface supported by a non-skid platform for stabilizing the device on the level plane.

7. The soccer training device of claim 1 wherein the weighted base further comprises a digital counter operationally mounted therein and electronically connected to the shaft member wherein each soccer ball rotation is tracked.

8. The soccer training device of claim 1 wherein the inertia member is a helical spring member operationally engaged below the speed bearing assembly.

9. The soccer training device of claim 1 wherein the speed bearing assembly further comprises a friction absorbing element operationally engaged with the lower end of the shaft member within the lower portion of the housing.

10. The soccer training device of claim 9 wherein the friction absorbing element comprises a ring with a surrounding channel for receiving a crown that encapsulates a plurality of ball bearings.

11. The soccer training device of claim 1 wherein the swivel connector member further comprises having a first rotating element 360 degree rotatably attached to an opposing rotating element.

12. The soccer training device of claim 1 wherein the shaft member further comprises:

an upper shaft portion and a lower shaft portion;

the upper shaft portion having a larger diameter than the lower shaft portion; and a lower end of the upper shaft portion abutting the speed bearing assembly and rotating independently than the lower shaft portion.

13. The soccer training device of claim 7 wherein the digital counter further comprises a display electronically connected to the digital counter for displaying thereon the number of rotations.

14. The soccer training device of claim 13 wherein the digital counter further comprises a timer electronically connected to the digital counter for setting an allowed amount of time for the user.

* * * * *